United States Patent [19]

Lobo

[11] 3,945,042

[45] Mar. 23, 1976

[54] PROTECTIVE GARMENT FOR SKATERS, AND THE LIKE

[76] Inventor: Alfred D. Lobo, 2655 Euclid Hts. Blvd., Cleveland Heights, Ohio 44106

[22] Filed: July 2, 1975

[21] Appl. No.: 592,614

[52] U.S. Cl. ..... 2/2

[51] Int. Cl.[2] ..... A41D 13/00

[58] Field of Search ..... 2/2, 93, 2.5, 22, 23, 1, 2/16; 128/78, 89 R; 428/911

[56] References Cited

UNITED STATES PATENTS

| | | | |
|---|---|---|---|
| 1,144,150 | 6/1915 | Marcovsky | 2/2 |
| 1,253,260 | 1/1918 | Levinson | 2/2 |
| 1,529,981 | 3/1925 | Biton | 2/1 |
| 1,600,410 | 9/1926 | Hartman | 2/2 |
| 3,877,077 | 4/1975 | Chapdelaine | 2/22 |

*Primary Examiner*—G. V. Larkin

*Attorney, Agent, or Firm*—Alfred D. Lobo

[57] ABSTRACT

A lightweight protective garment is provided for skaters, skiers, and the like, to reduce the injury from a fall. The garment is worn over the torso primarily to cover the area of the lower back, upper back and arms. The fabric of the garment by itself has no impact protective function but serves simply to provide a base on which protective cushioning members are attached in such a way as to absorb a portion of the impact of a fall. The cushioning members are preferably in the form of resilient foamed plastic cylinders disposed exteriorly of the garment over selected areas of the body which are generally impacted most frequently such as the lower back, the trochanter region, the shoulders and the rear surfaces of the arms. In a preferred embodiment of the invention the cushoining members are removably affixed to the garment and a cover is provided over the cushioning members so that the garment appears to be conventional.

10 Claims, 6 Drawing Figures

PROTECTIVE GARMENT FOR SKATERS, AND THE LIKE

BACKGROUND OF THE INVENTION

This invention relates to an improved athletic protective garment for use by participants in sports where falls on a hard surface are common. It is more particularly directed to an outer garment to absorb the brunt of the inpact of a skater's or skier's fall.

It is well known that ice hockey requires hard body contact on the part of the participants, buth with one another and the ice surface. Some forms of roller skating competition make analogous demands on the participants. Other contact sports such as football make similar demands and protective padding is used under the uniforms worn by football and hockey players. Though numerous forms of protective padding have been devised for these players over the past several decades, it is noteworthy that all these designs are variations of the basic concept of disposing a pad over the part to be protected and fixedly locating the pad by strapping it to the torso. Having decided that a protective pad is to be strapped to the torso the problem was to devise a system of plural pads which permitted freedom of movement without sacrificing the basic protection desired. Thus it is not too surprising that protective padding for hockey players and football players bear more structural resemblances than disimilarities, and that this protective padding is notably effective.

However, not all skaters feel compelled to wear a hockey uniform when they skate, nor do all skaters play ice hockey. Just as pertinent, if not more so, is the fact that most skaters feel unduly conspicuous, if not constricted, when clad in heavy protective padding. Yet it is most desirable that all skaters be afforded some protection from bruising encounters with the ice surface. Figure skaters, ice dancers and the like, routinely risk injury because they feel unduly hampered by conventional protective padding. Advanced skaters have learned to fall, meaning, of course, that by dint of having experienced uncounted falls, they instinctively minimize the consequences of a fall. Moreoever, advanced skaters have usually become accustomed to falling since early childhood and are psychologically conditioned quite differently from skaters who commence the sport at a later age. Nonskating adults are so conditioned to fear a fall that the inevitable fall may have serious consequences, both physical and mental.

The protective garment of this invention is specifically constructed for skaters or skiers likely to fall on any hard surface, for the particular purpose of softening the impact of a fall and reducing injury caused by it. Though it will be immediately apparent that a skating surface is hard, it is not quite so apparent that a ski slope of packed snow can offer a degree of impact resistance comparable with that of ice or wood. Thus a fall on packed snow, particularly at relatively high speed, can be as bruising as a fall on ice. Moreover, ski slopes commonly include icy patches which present a difficult problem, and on which a fall can, and often does, result in serious injury. Thus, the garment of this invention may be adapted for use by skiers, the main difference being that, the skier's protective garment may have significant heat insulating characteristics to conserve body heat. Hereafter, for simplicity, we shall refer to the garment of this invention as a skater's jacket.

It should be noted in passing that there presently are available several forms of padding such as are used for protection of an ice-hockey goaltender, which would afford any skater adequate protection on the ice. For example, a skater whose torso is encased in padding such as described in U.S. Pat. No. 3,877,077 need not fear a fall. On the other hand, a skater wearing such padding on his legs, around his arms and over his upper and lower back areas, would have seriously restricted mobility and freedom of movement. Similarly a skater wearing a heavy leather jacket interiorly lined with a thick layer of a plastic foam of synthetic resinous material may also be afforded an adequate degree of protection, except that such a jacket would be highly insulating and most uncomfortable. As is well-known, skaters generate considerable body heat, and particularly in an indoor skating rink, heavy clothing can become oppressive. Thus it will be apparent that it is not sufficient that the skater be adequately protected from serious injury due to a fall, but that the skater also be permitted full freedom of movement while so protected.

Finally it is important that a skater wearing protective equipment feel comfortably inconspicuous. It is unnecessary to dwell upon the undesirability of a skier or figure skater practicing in the garb of a quarterback wearing goalie's pads. Even this combination, far-fetched though it may be, would provide inadequate protection for the upper back region and the region immediately below the trochanter along the exterior sides of the upper femur.

Interestingly, injuries in free skating, figure skating, ice dancing, and roller skating are most frequent in the area of the lower back, the arms and the region immediately above and below the trochanter. Head injuries are infrequent except among the most inexperienced skaters, and it is unusual for skaters other than ice hockey players to wear helmets. To date there is no protective garment available for a skater, which garment may be worn over street clothes in a simple and inconspicuous manner.

SUMMARY OF THE INVENTION

It is therefore a general object of this invention to provide an impact absorbing jacket of the type which can be releasably fastened over the torso of a sport participant such as a skater, to reduce the injury due to a fall; which is moderately priced; which is easily tailored to users of various sizes, athletic ability and tolerance of falls; which is easy to clean; which is a dual-purpose garment usable on the street and also for sports because of the ease with which it can be assembled or disassembled for one use or the other.

It is also a general object of this invention to use a conventionally made jacket of a lightweight, yieldable fabric as a base on which impact absorbing cushioning means are non-rotatably affixed in a minor portion of the exterior surface of the jacket.

It is a specific object of this invention to provide a skater's jacket having a washable lightweight cotton or nylon main body portion arranged to cover the skater's body from his neck about down to his thighs, and including elongated cushioning members exteriorly disposed on the main body at regions most generally impacted when the skater falls. The main body portion includes a vest section and sleeve sections sewn to the vest section. The cushioning members are attached to the rear and sides of the sleeve sections, to the exterior rear of the vest section, and to the lower exterior sides of the vest section.

It is a further specific object of this invention to provide removable cushioning members exteriorly disposed on impact areas of a skater's jacket.

It is yet a further specific object of this invention to provide plural cylindrical, flexible, resilient foamed plastic cushioning members, each member in generally parallel relationship laterally spaced apart from a next adjacent member at a distance equal to or less than the diameter of each member to dissipate the impact of a fall.

It is also another specific object of this invention to provide an impact-absorbing skater's jacket which may be laundered when the cushioning members are removed, and which may be worn as a conventional jacket when protection against a fall is not wanted.

It is a further specific object of this invention to provide an assembly of plural ribs sheathed in parallel spaced apart relationship and fastening means for removably securing the assembly to a jacket at locations likely to be impacted in a fall.

It is still another specific object of this invention to provide a fabric sheath removably disposed over cushioning members exteriorly disposed on a minor portion of the area of a skater's jacket, so that the fabric sheath substantially obscures the presence of the cushioning members from a casual observer.

These and other objects and advantages of this invention will become apparent to those skilled in the art from the following description of preferred forms thereof, and the illustrations set forth herein.

FIB. 5 is a front perspective view of a sleeve portion of the skater's jacket showing cushioning members in spaced apart end-to-end relationship at the elbow, to permit ease of bending the arm.

Figure 6:
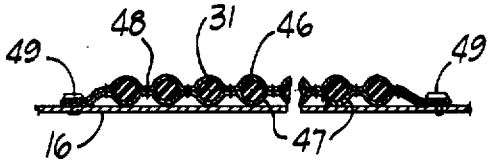

FIG. 6 is a horizontal section of still another embodiment of an assembly of plural ribs individually sheathed between upper and lower pieces of yieldable fabric, and provided with means for removably fastening the assembly upon a preselected portion of a skater's jacket.

In the figures of the drawings, like reference numerals are used to denote like parts.

DETAILED DESCRIPTION OF PREFERRED EMBODIMENTS OF THE INVENTION

Figure 1:
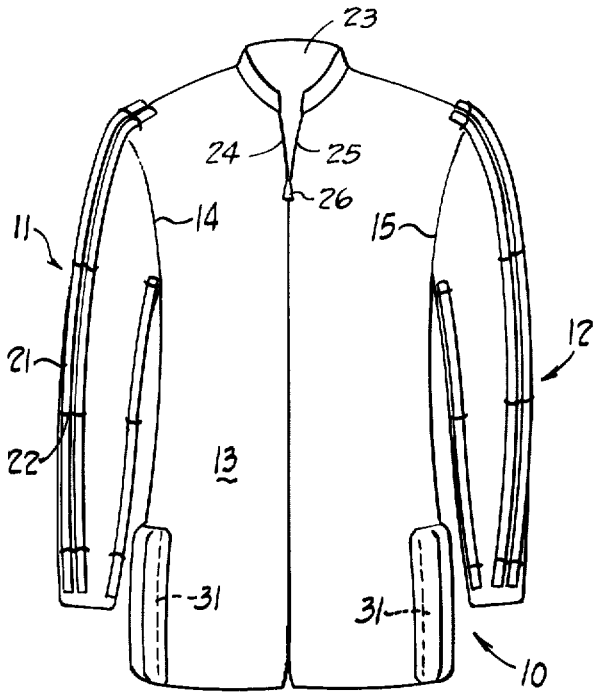
FIG. 1 is a front elevation perspective view illustrating a skater's jacket to which plural elongated cushioning members are fastened.

As has been stated hereinabove it is apparent that sufficient protection can be afforded a skater simply by encasing him in a sufficiently large mass of resilient impact absorbing material. Since this would interfere with the skater's ability to skate, it is impractical. A preferred embodiment of a practical impact-absorbing garment is illustrated in FIG. 1 of the accompanying drawings wherein is shown a skater's jacket having an upper body portion, indicated generally by the reference numeral 10, to cover the upper body of the wearer, namely the torso and arms. The upper body portion 10 includes arm portions indicated generally at 11 and 12, and a vest portion indicated generally at 13. The upper body portion 10 is preferably made from an yieldable, lightweight fabric. By yieldable I refer to a fabric which offers substantially no resistance to deformation such as is characteristic of a fabric for a garment used in a conventional manner. For example the wearer of the upper body portion 10 can easily bend his arms in the arm sections 11 or 12. By lightweight I refer to fabric which weighs less than 7.5 ounces per square yard, and exclude fabrics which have resistance to penetration by projectiles, fabrics for underwater suits, fire fighting suits and the like.

It might be mentioned here that the garment of this invention has no efficacy for any of these aforementioned purposes namely bullet protection or fire protection and will not support a non-swimmer on water. Its sole purpose is as a jacket to lessen the impact of a skater's or skier's fall.

A preferred fabric for the upper body portion 10 is cotton, wool or a synthetic resinuous nonabsorbent monofilament fiber such as are commonly available as polyesters, polyacrylonitriles, nylon and the like. Preferred fabrics are of mixtures of cotton with wool or with synthetic fibers so that the upper body portion of the jacket is characteristically durable, yet comfortable and notably free-breathing.

Where the upper body portion is to be worn by a skater in an indoor rink it may be desirable to use a lightweight fabric such as duck, consisting of 100% cotton and weighing about 5 or 6 ounces per square yard. Where the upper body portion is required to have significant insulation against cold, as in a skier's jacket, quilted nylon fabric may be used, or a layered fabric having mixed natural and synthetic fibers. The upper body portion may be, and generally is made in the same way, and from the same fabric, as is conventionally used for a jacket designed for use in the particular sport, whether it be skiing or any form of skating. Typically the arm portions 11 and 12 are sewn to the vest portion 13, at seams 14 and 15, and the arm and vest portions are formed from the same fabric. Whatever the lightweight, yieldable fabric chosen, whether cotton, wool, polyester, nylon or the like, it is essential for skating that the fabric be a porous woven fabric which breathes. Characteristically the fabric has essentially no cushioning effect against a blow, either from a fist or from a fall against a hard surface, and thus affords no substantial protection against impact for a body clad in the fabric.

The arm portions 11 and 12 cover the right and left arms of the wearer from the shoulder to the wrist, and may be fabricated in any known manner such as used to provide sleeves for garments of the jacket types conventionally used by sports participants. Because of the frequency of impact, it is critical that each arm portion carries, in the rear region thereof and exteriorly disposed thereupon, plural elongated compressible, flexible ribs or cushioning means, 21, hereinafter referred to simply as ribs, running from the shoulder to below the elbow, in generally parallel spaced apart relationship. The ribs are flexible and resilient so that not only the ribs, but also the fabric to which they are fastened, may be easily flexed in response to articulation of the elbow, without substantially natural arm movement.

The material from which the ribs 21 are formed is not critical provided it provides adequate cushioning capacity with a relatively small mass. Rubber tubing having a sufficient wall thickness, such as common garden watering hose, provides adequate cushioning but is typically so heavy as to be undesirable. Felt and cotton padding have been used in prior art protective clothes, but are inadequate, because of too slow a recovery, and too much weight. Preferred materials for the ribs 21 are flexible, resilient, foamed synthetic resinous materials such as are currently designated as foamed polyurethanes, foamed polylactam, foamed low density polyethylene and the like, characterized by relative ease of compression, great resilience and good elastic memory. These materials are also referred to as semi-rigid foamed plastics. Particularly preferred is a foam vinyl plastic formed from polyvinylchloride sponge having a closed or unicellular structure, or a foam polyurethane, polyethylene or polystyrene which have a characteristic slow rebound after impact because of their unicellular structure. The bulk density of a preferred material is in the range from about 5 lbs/ft$^3$ to about 15 lbs/ft$^3$, the lighter foams being preferred if they have the desired cushioning ability. Typically, a 1 inch diameter cylinder of such a foam plastic can be diametrically compressed, between the fingers of a man's hand, in the range from about 4 mm. to about 10 mm.

Though the shape of the cross section and the dimensions of each rib are not critical, it will be apparent that the smaller the effective diameter of each rib, the less conspicuous will be the ribs, and the more pleasing will be the appearance of the jacket. Thus it is more desirable to have many ribs of relatively smaller cross-section than two or three ribs of relatively large cross-section. Though the cross-section may be arbitrary it will be apparent that conveniently extruded cross-sectional shapes are preferred, such as cylindrical or elliptical, or half sections of these shapes. Most preferred is a cylindrical shape because compressible cylindrical ribs lend themselves to being positioned in such a manner as to absorb and distribute an impacting force to proximally adjacent ribs with a minimum of mass.

It will be evident that the mass of the wearer, the degree of encumbrance to be endured, the expected force of impact in a particular sporting activity, and the degree of protection sought under that impact, will determine the size of the ribs and their spacing. Clearly, a few small-diameter relatively distally spaced apart ribs will provide a child more protection than an adult. Thus, for an adult, though small diameter ribs less than 1 cm. in nominal diameter may afford some protection, if sufficiently closely spaced as will be described hereinafter. it is preferred to use ribs having a nominal diameter from about 1.25 cms. to about 5.0 cms. It will be recognized that, from a practical point of view, it is desirable to use the least number of ribs, of as small a diamter as is consistent with providing adequate protection, without sacrificing overall appearance. The most preferred diameter is in the range from about 1.25 cms. to about 3.75 cms.

Each rib 21 is fastened to the exterior of the arm portions 11 and 12 by fastening means 22 which will secure and maintain the ribs in position even after a fall. Typically, fastening means 22 may be a narrow strip of material provided with spaced vertical lines of stitching (not shown) which form spaced vrtically extending loops of prederermined size each adapted to snugly secure an individual rib which is compressed thereby. The ribs are inserted into and removed from the loops by compressing them manually between the fingers. The precise number of ribs used will depend upon the size of the ribs and the areas to be protected. Typically each rib 21 on an arm portion extends from the shoulder to below the elbow, preferably down to the wrist, as shown in FIG. 1, and the front area of the arm portion is not protected. The unprotected area lies, approximately along the pronator teres muscle, on either side of a direct line from the base of the thumb on the shoulder, when the arm is extended. This front vertical portion of the arm is least likely to be impacted in a fall and coincidentally, the absence of ribs here, facilitates the free flexure of the arm. The remainder of each arm portion is covered with the flexible ribs to provide protection, both for the upper and lower arms, at all points likely to be impacted.

The precise form of fastening means is not critical, and it is preferred that the fastening means be adapted to removably secure the flexible ribs, either individually or as an assembly of plural ribs, as will be described in more detail hereinafter.

The vest portion 13 has a neck opening 23 and is split down the front from the neck opening to near the bottom of the vest portion, marginal edges 24 and 25 of the split being provided with releasable fastening means 26 to open and close the split. Typically, a slide fastener means or zipper is provided to allow the upper body portion to be placed about the arms and shoulder, with the split open, thus clothing the upper body of the wearer, and then to secure the upper body portion in position.

Figure 2:
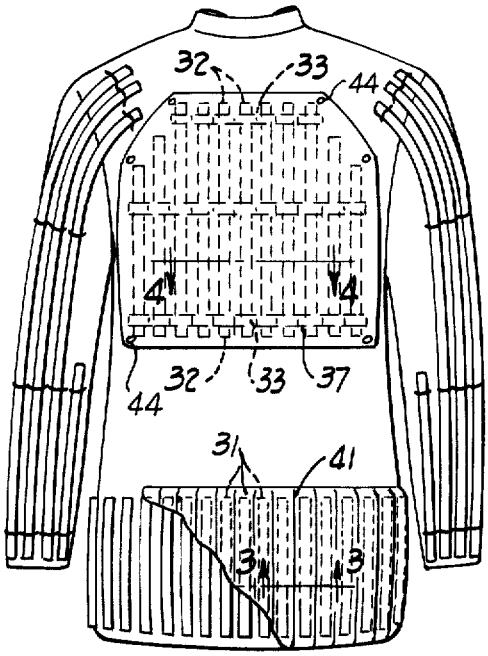
FIG. 2 is a rear elevation perspective view illustrating the back of the skater's jacket, shown in FIG. 1, and plural elongated cushioning members or ribs fastened to the back with narrow strips sewn to base fabric of the jacket.

The vest portion is of sufficient length to cover the buttocks of the wearer in the rear, and extends to the front to cover the upper thighs. The front of the vest portion is unprotected against impact, and essentially free of ribs except for generally vertical short ribs (shown in FIG. 1) near the edges of the pelvic bone, also known as the trochanter region. Additional vertical short ribs 31 extend exteriorly in generally laterally spaced apart relationship over the remaining lower portion of the vest as illustrated in FIG. 2 as will be described hereinafter. The lower back, sacrum and seat regions, and particularly the trochanter region, of the wearer are thus protected in most falls.

It will be evident that some impact protection, no matter how small, may be derived from very few ribs irrespective of their spacing. It is found however, that superior protection is obtained when the ribs are laterally spaced apart in generally parallel relationship at a distance less than the diameter of a rib, assuming the ribs 31 are of the same diameter. In other words a desirable rib spacing is about the width of a rib, or the spacing between longitudinal axes of adjacent ribs is twice the diameter of a rib. For cushioning material which is relatively more compressible, a more preferred rib spacing is less than about half the width of a rib, or the spacing between longitudinal axes of adjacent ribs is less than the diameter of a rib. In this relatively closely spaced position, upon inpact from a fall, the directly compressed ribs absorb and distribute the impacting force to adjacent ribs. During impact, plural ribs are then simultaneously compressed so as to circumferentially touch a next adjacent impacted ring if the impact is sufficiently large. The rib spacing on the arm portions 11 and 12 may be the same as the rib spacing on the vest portion 13, or different, depending upon the protection desired and the cushioning materials used.

The back of the vest portion covers the upper back, waist, lower back and seat regions of the wearer, as is illustrated in FIG. 2. The back of the vest portion, like the front, carries no ribs in the waist area. This permits freedom of movement for bending at the waist, so essential to sports participants. The upper back portion of the vest portion, that is the area between the shoulders and extending from the neck to the bottom of the rear of the rib cage is also provided with elongated cushioning members or ribs, referred to as long ribs 32, fastened to the exterior of the upper back portion with a sheath fastening means 41 described more fully hereinbelow. The long ribs 32 are referred to as long ribs because they are generally longer than the ribs 31, though it will be apparent there is nothing critical about the relative lengths of the ribs 31 and 32.

Figure 5:
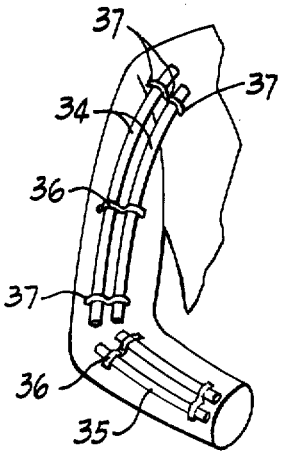

It will also be apparent that the ribs 21 on the arm sections will generally be longer than either ribs 31 or 32. If desired, greater freedom of elbow articulation may be obtained by substituting ribs 34 and 35 as shown in FIG. 5, and fastening them to the exterior of the arm portions with narrow strips 36. Ribs 34 and 35 are placed in adjacent end-to-end relationship with each other but are not necessarily longitudinally aligned. A slight space is provided between the adjacent ends of ribs 34 and 35 to minimize the effort required to articulate the elbow.

The fastening means 36, like fastening means 22, may be a strip of fabric sewn to the fabric of the arm portions 11 and 12 at predetermined spacings so as to leave loops under which the ribs 34 and 35 may be snugly accomodated. The loops may be half-pipe folds, more or less, to accomodate either a cylindrical, or semicylindrical rib. Clearly the shape the loops acquire will depend at least in some measure upon the cross-section of the ribs, and the shape of a loop holding a rib is not critical so long as the ribs are held securely to the fabric. It is preferred to sew several fastening strips 36, preferably with double-sewn seams 37 to secure the ribs, and the strips are spaced in substantially parallel rows to provide vertically aligned loops running in spaced relation around the arm portions, the lower vest portion, and across the upper back of the vest portion. Similar fabric strip fastening means may be used to secure the ribs 21, 31 and 32.

Figure 3:
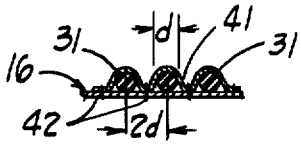
FIG. 3 is a horizontal section along the line 3—3 of FIG. 2 of an embodiment wherein the narrow strips are replaced with a sheath which individually sheaths each rib.

Since the ribs are manually compressible, and the fabric of the upper body portion 10 is yieldable and not rigid, the fabric strip fastening means 36 may be made from a substantially non-stretchable material. If desired, however, a stretchable fabric strip fastening means 22 may be used. Any elastic fabric material such as the woven synthetic fiber materials known as Spandex, Lycra, and the like, may be used. Such elastic fabric strip fastening means are particularly suitable for interchanging ribs of varying diameter and for relatively closely spaced ribs of relatively easily compressible foamed plastic material. As illustrated in FIGS. 3 and 5, the ribs may be spaced so as to leave a space of about a rib diameter *d* between the ribs. Too great a rib spacing does not distribute the force of an impact on enough ribs, and too close a spacing interferes with the comfort of the jacket, not to mention increasing its cost unnecessarily. When several ribs which are spaced slightly less than one diameter apart in generally parallel relationship longitudinally, are impacted, they are compressed into tangentially abutting relationship with each other at the point of inpact, and thus efficiently absorb and distribute the force of the impact.

The ribs secured as described above provide effective protection and yet are easily removed manually when the upper body portion is to be washed or dry-cleaned. This ease of removal of the ribs is especially important because foam plastic ribs do not lend themselves to each washing or dry-cleaning with solvents. Ribs secured in the manner described above are readily visible, and it may be desired to blend them more effectively into the background of the fabric of the upper body portion. It is desirable that ribs removably fastened as described, by inserting each rib through aligned passages provided by the loops, be suitably colored to provide a pleasing visual appearance on the fabric of the upper body portion.

Since it is inconvenient and generally difficult to color and dye foam plastic ribs, it is sometimes preferred to provide a snugly fitting sheath 41, as shown on the long ribs 32 on the upppr back of the vest portion, and in FIG. 3. The sheath 41 is made from the same fabric used to fabricate the upper body portion and snugly sheathes individual ribs over their entire length. Though the outlines of the ribs are still discernible, they are less noticeable when sheathed with the same fabric than they would be when secured with a different fabric or with strip fastening means 22 and 36 illustrated in FIGS. 1 and 5. The sheath 41 is placed to overlie the fabric material of the upper body portion 10, over a preselected area, and parallel seams 42 are sewn, preferably reinforced in any conventional manner for strength, spaced apart at a preselected distance about one rib diameter apart, so as to provide pleats having passages which will snugly accommodate individual ribs which are inserted therein. If relatively easily compressible ribs are used it is preferred that the fabric of the sheath 41 be relatively non-stretchable, so that upon impact, the sheath 41 resists radially outward distortion of individual ribs.

Figure 4:
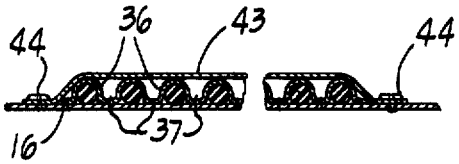
FIG. 4 is a horizontal section of another embodiment wherein plural ribs fastened individually with narrow strips are covered with a sheath.

The ribbed look, as shown in FIG. 3, of ribs sheathed in the same fabric as the upper body portion, may be counteracted, as shown in FIG. 4, by sheathing a plurality of ribs which are already secured to the fabric of the upper body portion with strip fastening means 22 or 36 as shown in FIGS. 1 and 5. The upper back of the vest portion and the row of ribs partially encircling the lower back and seat region of the vest portion, are particularly well-suited for being sheathed with a sheath which covers but does not secure the ribs. Referring now to FIG. 4, there is shown a cross-section view, with a portion broken away, of such a sheath if it covered the upper back of the vest portion shown in FIG. 2. Plural long ribs 32 are individually secured by a fabric strip 33 sewn to the fabric of the upper back of the vest portion at seams 37. The ribs 32 are vertically disposed in parallel spaced apart relationship by several fabric strips 33, and extend from one shoulder across to another. It is not essential that the long ribs 32 be vertically disposed, as are the short ribs 31 on the lower vest portion, but the vertical disposition is preferred. A lightweight, yieldable fabric cover 43, preferably of the same fabric as the upper body portion so as to match it, covers all the long ribs 32. It is preferred that the cover 43 be fabricated to cover the ribs snugly, so that it is stretched over the ribs, exerting a slight pressure thereupon. Fastening means such as cooperating snap-tabs or press-on fasteners 44 of the conventional type are provided near the edges of the cover, so as to permit the cover to be removably secured to the upper back of the vest portion. Similar covers (not shown) may be provided for ribs placed at other impact areas of the upper body portions, also removably secured by conveniently placed snap-type fasteners the cooperating portions of which are secured to the fabric 16 of the upper body portion and to the cover respectively.

As described hereinabove, the fabric strip fastening means are sewn to the fabric of the upper body portion so as to provide a series of loops which are fixedly attached to the upper body portion. These loops may be deemed unattractive when the upper body portion is worn without the ribs secured thereto, In this event, an assembly of ribs may be individually sheathed, as shown in the cross-section view illustrated in FIG. 6. There are shown several short ribs 31 each individually sheathed between an upper fabric sheet 46 and a lower fabric sheet 47, which are sewn together with spaced vertically extending longitudinal seams 48 at preselected intervals so as to snugly encase individual ribs. An assembly of ribs, preferably spaced apart at about one diameter from the another, is thus formed which may be removably secured as an assembly to any desired portion of the upper body portion 10, by any suitable fastening means 49. As described hereinbefore, a particularly simple manner of removably securing the assembly of ribs to the lower vest portion, is with snap-type fasteners suitably placed at intervals along the marginal edged of the assembly, and corresponding locations on the lower vest portion. Another convenient means for fastening such an assembly of individually sheathed ribs is with VELCRO strips of cloth tape which have tiny interlocking fingers or microscopic hooks which fasten one strip to another by pressure, and which are disengaged by pulling the strips apart. One piece of tape is sewn to the outside of the upper body portion, and another is sewn to the encasing fabric sheets of the rib assembly, so the assembly may be removed whenever the upper body portion of the jacket is to be used without the ribs.

An assembly of ribs may be similarly fabricated for the upper back of the vest portion, and for the arm portions. Rib assemblies are especially well adapted for use on the arm portions when used as separate assemblies for the lower and upper arm to permit ease of articulation of the arm at the elbow.

From the foregoing description it will be seen that a conventional jacket of the type commonly used by sports participants, unexpectedly lends itself to a most useful and surprisingly versatile skater's or skier's jacket. The efficacy of the jacket to lessen impact is the more surprising because only a minor portion of the area of the jacket, essentially less than half the exterior area, is covered with the ribs, causing no objectionable discomfort. The jacket of this invention may be worn with the ribs displayed, or with the outline of the ribs readily discernible under a sheath which secures individual ribs, or with a covering sheath which effectively obscures the true function of the jacket of this invention. Again, the jacket may be converted from its impact-lessening function to street wear by merely detaching an assembly of ribs from the exterior surface of the jacket.

Modifications, changes and improvements to the preferred forms of the invention herein disclosed, described and illustrated may occur to those skilled in the art who come to understand the principles and precepts thereof. Accordingly, the scope of the patent to be issued hereon should not be limited to the particular embodiments of the invention set forth herein, but rather should be limited by the advance by which the invention has promoted the art.

I claim:

1. An outer garment for skaters and skiers worn primarily over the wearer's torso to reduce injury due to falls, comprising in combination:

an upper body portion to cover the upper body of the wearer from below the neck to just below the buttocks, said upper body portion being made of an yieldable fabric having essentially no cushioning property against impact;

said upper body portion including a. arm portions, to cover the arms of the wearer, extending on either side of a neck opening, each arm portion carrying exteriorly thereupon plural elongated flexible cushioning members running from the shoulder to below the elbow in generally parallel spaced apart relationship;

b. a back portion to cover the back of the wearer, said back portion carrying exteriorly thereupon plural elongated cushioning members running in generally parallel spaced apart relationship; and c. a seat portion to cover the buttocks of the wearer, said seat portion carrying exteriorly thereupon plural elongated cushioning members running vertically in generally parallel spaced apart relationship, and extending circumferentially to cover the trochanter region of each side;

said upper body portion being split down the front from the neck opening to near the bottom of the upper body portion; and cooperating releasable fastening means to open and close the split.

2. The outer garment of claim 1 wherein said plural members run the entire length of each arm, and protect the rear and side portions of each arm leaving a minor portion of each arm unprotected, said minor portion being the front area of the arm on either side of a line drawn from the thumb to the shoulder.

3. The outer garment of claim 2 wherein said upper body portion is unprotected by said elongated cushioning members over essentially the entire frontal area and over the entire waist area to permit essentially complete freedom of movement.

4. The outer garment of claim 3 wherein said elongated cushioning members are individually sheathed and secured against rotation in an overlying sheath affixed to the exterior surface of the fabric of said upper body portion so as to form approximately half-pipe folds in which said elongated members are snugly inserted.

5. The outer garment of claim 3 wherein said elongated cushioning members on said arm portions are discontinuous about the circumference to the elbow for ease of articulation thereof, and are placed in adjacent end-to-end relationship with each other.

6. The outer garment of claim 3 wherein said elongated cushioning members are formed from foamed synthetic resinous material of unicellular structure having a characteristic slow rebound after impact, and a density in the range from about 5 $lbs/ft^3$ to about 15 $lbs/ft^3$.

7. The outer garment of claim 6 wherein said elongated cushioning members have a diameter in the range from about 1.25 cms. to about 5 cms.

8. The outer garment of claim 7 wherein said elongated cushioning members are removably secured to said outer body portion.

9. The outer garment of claim 8 wherein said elongated cushioning members are secured in parallel spaced apart relationship wherein the longitudinal axes of adjacent said members are spaced at a distance greater than the diameter of one said member and no more than twice the diameter of one said member.

10. The outer garment of claim 9 wherein said elongated cushioning members are sheathed between an upper fabric sheet and a lower fabric sheet sewn together with spaced vertically extending longitudinal seams at pescd ls to sbly s sd mmbs m assmbly movbly atched to preselected external areas of said upper body portion.

* * * * *